US008444496B2

(12) United States Patent
Lai et al.

(10) Patent No.: US 8,444,496 B2
(45) Date of Patent: May 21, 2013

(54) LATERAL DYNAMIC SIMULATION DEVICE

(75) Inventors: Deng-Horng Lai, Kaohsiung (TW); Ke-Cheng Chien, Kaohsiung (TW)

(73) Assignee: Brogent Technologies Inc., Kaohsiung (TW)

( * ) Notice: Subject to any disclaimer, the term of this patent is extended or adjusted under 35 U.S.C. 154(b) by 294 days.

(21) Appl. No.: 13/082,399

(22) Filed: Apr. 8, 2011

(65) Prior Publication Data

US 2012/0258810 A1 Oct. 11, 2012

(51) Int. Cl.
*A63G 31/16* (2006.01)
*A63G 31/00* (2006.01)

(52) U.S. Cl.
USPC ..... 472/59; 472/130

(58) Field of Classification Search
USPC ..... 472/59, 60, 61, 75, 76, 130; 434/29, 434/55, 58
See application file for complete search history.

(56) References Cited

U.S. PATENT DOCUMENTS

| | | | | |
|---|---|---|---|---|
| 5,453,011 | A | 9/1995 | Feuer et al. | |
| 7,033,177 | B2 * | 4/2006 | Kim | 434/58 |
| 2003/0224333 | A1 * | 12/2003 | Vastvedt | 434/29 |

FOREIGN PATENT DOCUMENTS

| | | | |
|---|---|---|---|
| EP | 2210652 | A1 | 7/2010 |
| JP | 10207338 | A | 8/1998 |
| KR | 100212326 | B1 | 10/1999 |
| WO | WO2007059236 | A2 | 5/2007 |

OTHER PUBLICATIONS

EP Serach Report.
KR Official Action issued on Oct. 19, 2012.

* cited by examiner

*Primary Examiner* — Kien Nguyen
(74) *Attorney, Agent, or Firm* — Chun-Ming Shih; HDLS IPR Services

(57) ABSTRACT

A lateral dynamic simulation device includes a positioning platform (1), a motor mechanism (2) and a carriage (3). The positioning platform (1) has an upright positioned arm (10). The motor mechanism (2) has multiple degrees of freedom and comprises a base (20), a platform (21) and a plurality of stretchable bars (22) to join the base (20) and the platform (21) by the universal joints (220). The carriage (3) has a space (30) at the frontal portion for carrying passengers and a back portion (31) at the rear portion. The base (20) of the motor mechanism (2) is fixed to the arm (10) of the positioning platform (1) and the platform (21) of the motor mechanism (2) is fixed to the back portion (31) of the carriage (3).

10 Claims, 7 Drawing Sheets

LATERAL DYNAMIC SIMULATION DEVICE

BACKGROUND

1. Technical Field

The present invention relates to an entertainment facility. More particularly, the present invention relates to a lateral dynamic simulation device that is capable of performing in six degrees of freedom of motion with the Stewart Platform.

2. Related Art

Stewart Platform is a parallel working platform including six linear actuators, six universal joints, which join the upper and lower parts, and the platform and the base. The six linear actuators has varieties of lengths to motivate the universal joints to lead the platform on the top position in different positions and angles, thus to satisfy the inquiry for operation.

The conventional technique of applying Stewart Platform in the entertainment facility includes placing the passenger carriage above the Stewart Platform in the early stage, or reversely hang the Stewart Platform in the air and beneath the Stewart Platform. The former is an older design and the latter is designed based on the dynamic simulation for the reality and the convulsion. The dynamic force motors from the top of the carriage thus to enable the players to experience the simulation of reality.

However, the Stewart Platform is designed to position above the rear part of the carriage that substantially blocks the view to the carriage, and accordingly the surrounding layout and design. After all, such dynamic simulation for the entertainment facility not only provides the players the physical experience but also the visual and audio effects. Therefore, if the surrounding layout and design are affected, the reality simulation cannot be as good as it supposed to be.

BRIEF SUMMARY

The present invention provides a lateral dynamic simulation device including a motor mechanism. The Stewart Platform, with six degrees of freedom positioned behind the carriage is connected to a motor to enable the players to feel the reality of hanging in the air while sitting in the carriage without affecting the surrounding layout and design since the Stewart Platform is positioned at the rear side of the carriage.

The present invention provides a lateral dynamic simulation device comprising a positioning platform, a motor mechanism and a carriage. The positioning platform comprises an upright arm. The motor mechanism comprises a plurality of degrees of freedom and comprises a base and a platform and a plurality of stretchable bars connecting the base and the platform. The stretchable bars are connected to the base and the platform by the universal joint. The carriage comprises a seating space at a frontal portion for carrying passengers; and the back side of the seating space is a rear portion of the carriage. The base of the motor mechanism is fixed positioning on the arm of the platform, and the platform of the motor mechanism is securely connected to the rear portion of the carriage.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
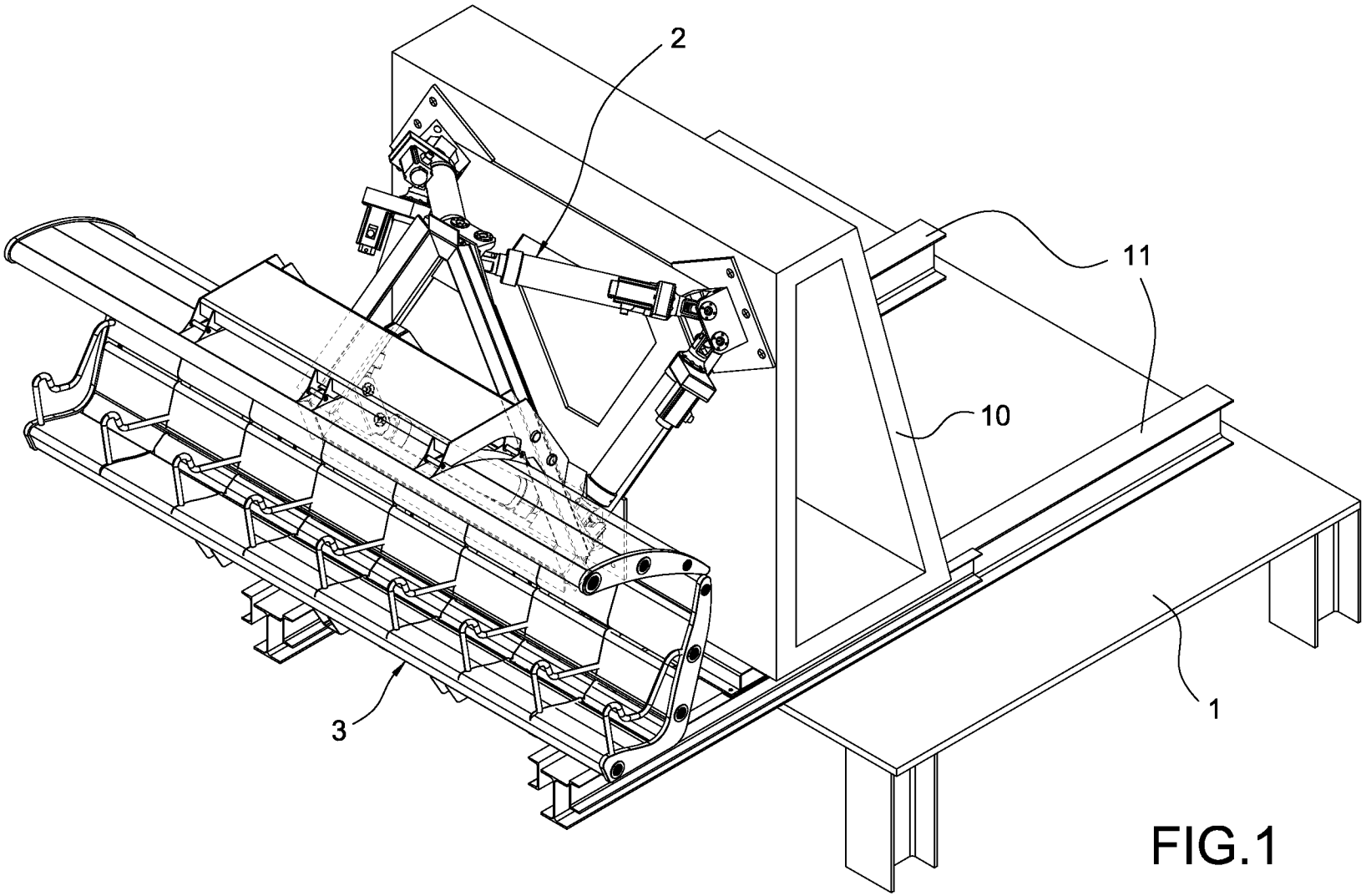
FIG. 1 is a perspective view of the present invention.
Figure 2:
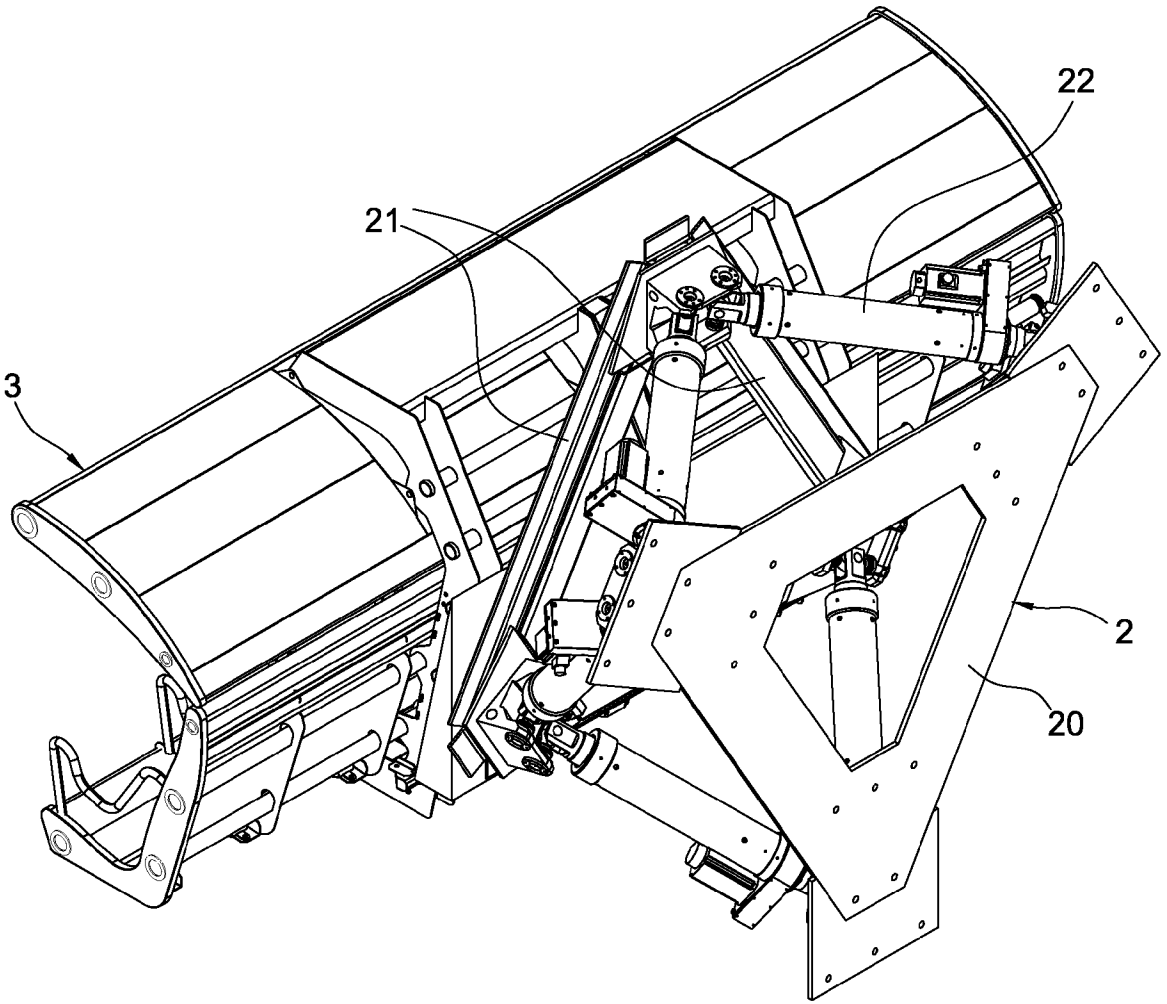
FIG. 2 is a perspective view along another angle of the present invention.

Referring to FIGS. 1 and 2, perspective and perspective view along another angle of the present invention, the present invention provides a lateral dynamic simulation device comprising a positioning platform 1, a motor mechanism 2 and a carriage 3.

The positioning platform 1 is for placing and fixing the dynamic simulation device on the ground, and comprises an upright arm 10 positioned erectly for positioning the motor mechanism 2. In the embodiment of the present invention, the positioning platform 1 comprises a sliding track 11 for the arm 10 to move horizontally therein.

Figure 3:
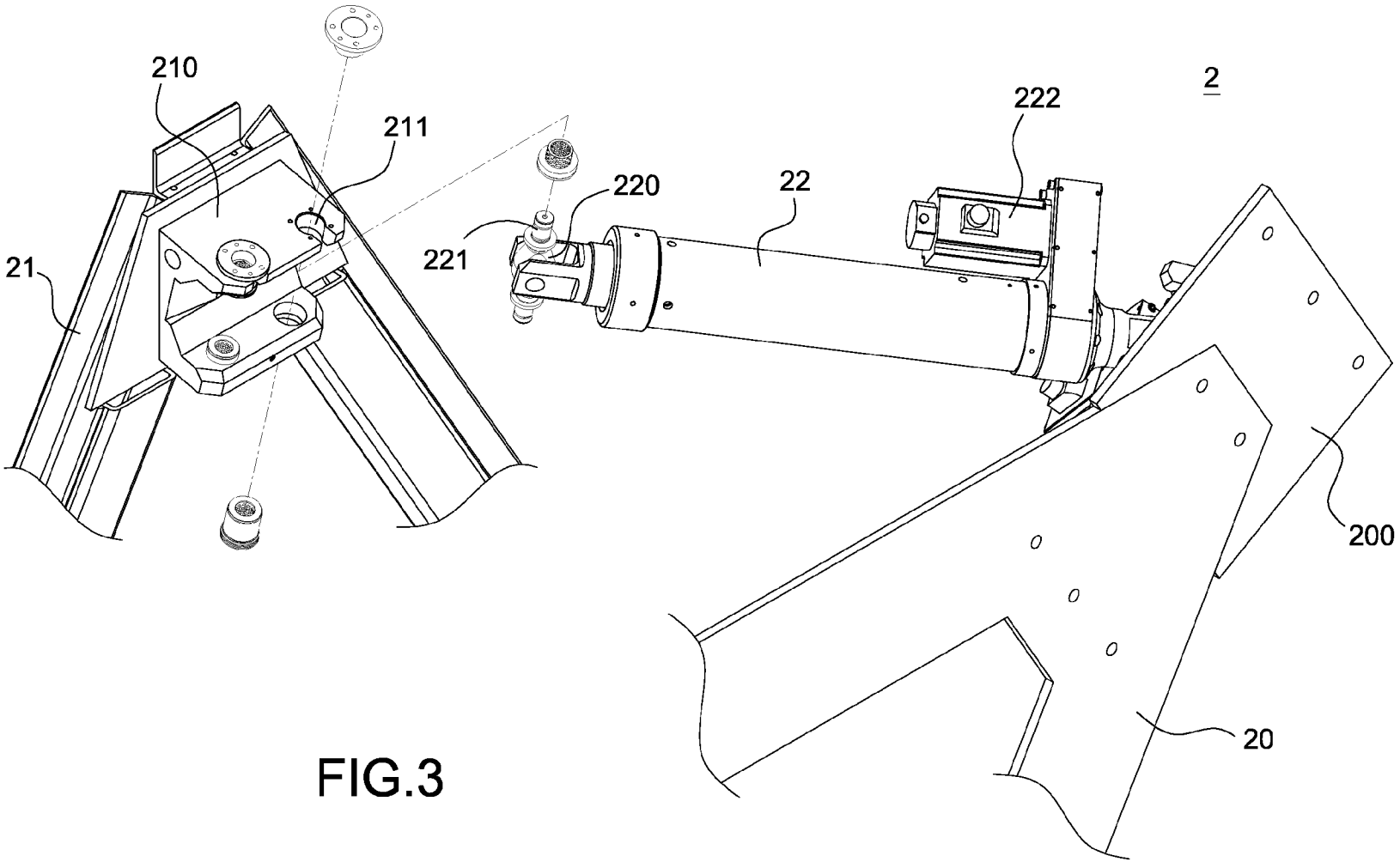
FIG. 3 is a local exploded view of a motor mechanism of the present invention.

The motor mechanism 2 comprises six degrees of freedom. Referring to FIG. 3 at the same time, the motor mechanism 2 comprises a base 20, a platform 21 and a plurality of stretchable bars 22 for connecting the base 20 and the platform 21. The stretchable bars 22, the base 20 and the platform 21 are joined by the universal joint 220. The assembly of the above elements forms the motor mechanism 2 with six degrees of freedom, for example the Stewart Platform. In the embodiment of the present invention, the base 20 and the platform 21 are formed in triangular shape and positioned alternatively for the stretchable bar 22 to connect the tips of the triangular base 20 and the platform 21. Furthermore, the base 20 and the platform 21 also comprise axial portions 200, 210 at the triangle tips, and the axial portions 220, 210 comprise axial holes 211 for receiving the universal joints 220 of the stretchable bar 22. The universal joints 220 of stretchable bars 22 comprise a protruded axle 221 to fit into the axial hole 211. The axial hole can be formed in a C-shape opening for receiving the corresponding axle 221. Every stretchable bar 22 can be a linear actuator and respectively control the length by a motor device 222. The motor device 222 can be a motor or an oil cylinder.

Figure 4:
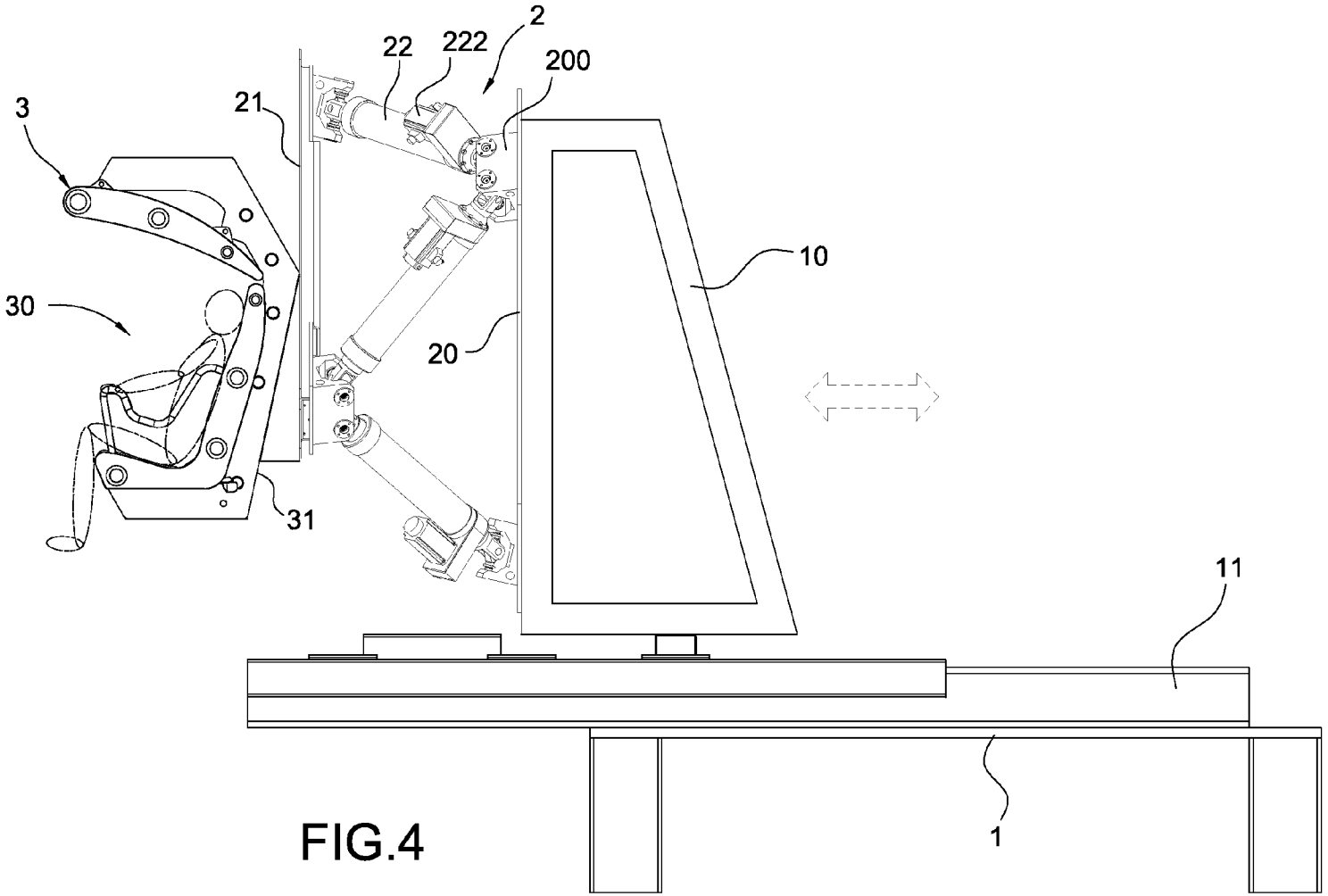
FIG. 4 is an aspect of operation of the present invention.

The carriage 3 is for carrying passengers, referring to FIG. 4, the carriage 3 comprises a space 30 at the frontal region for the passengers to sit and a back portion 31 behind the space 30 of the carriage 3. The present invention has the base 20 of the motor mechanism 2 fixed to the arm 10 of the positioning platform 1, and the platform 21 of the motor mechanism 2 is fixed to the back portion 31 of the carriage 3, thus the carriage 3 is positioned in air by the joining the motor mechanism 2 without having the frontal vision blocked by the motor mechanism 2. With the lateral position, the overall space occupation in height can be substantially reduced to benefit the surrounding layout and design.

Furthermore, referring to FIG. 4, the arm 10 of the positioning platform 1 is able to slide in the sliding track 11 and to move horizontally, thus when the arm 10 moves backward horizontally on the sliding track 11, the passengers can get on the carriage 3 easily as the carriage 3 is correspondingly positioned on the positioning platform 1. When the motor mechanism 2 is about to operate, the arm 10 moves forward horizontally by the sliding track 11 and push the carriage 3 out of the frontal side of the positioning platform 1 to allow the passengers to experience more excitement of hanging in air.

Figure 7:
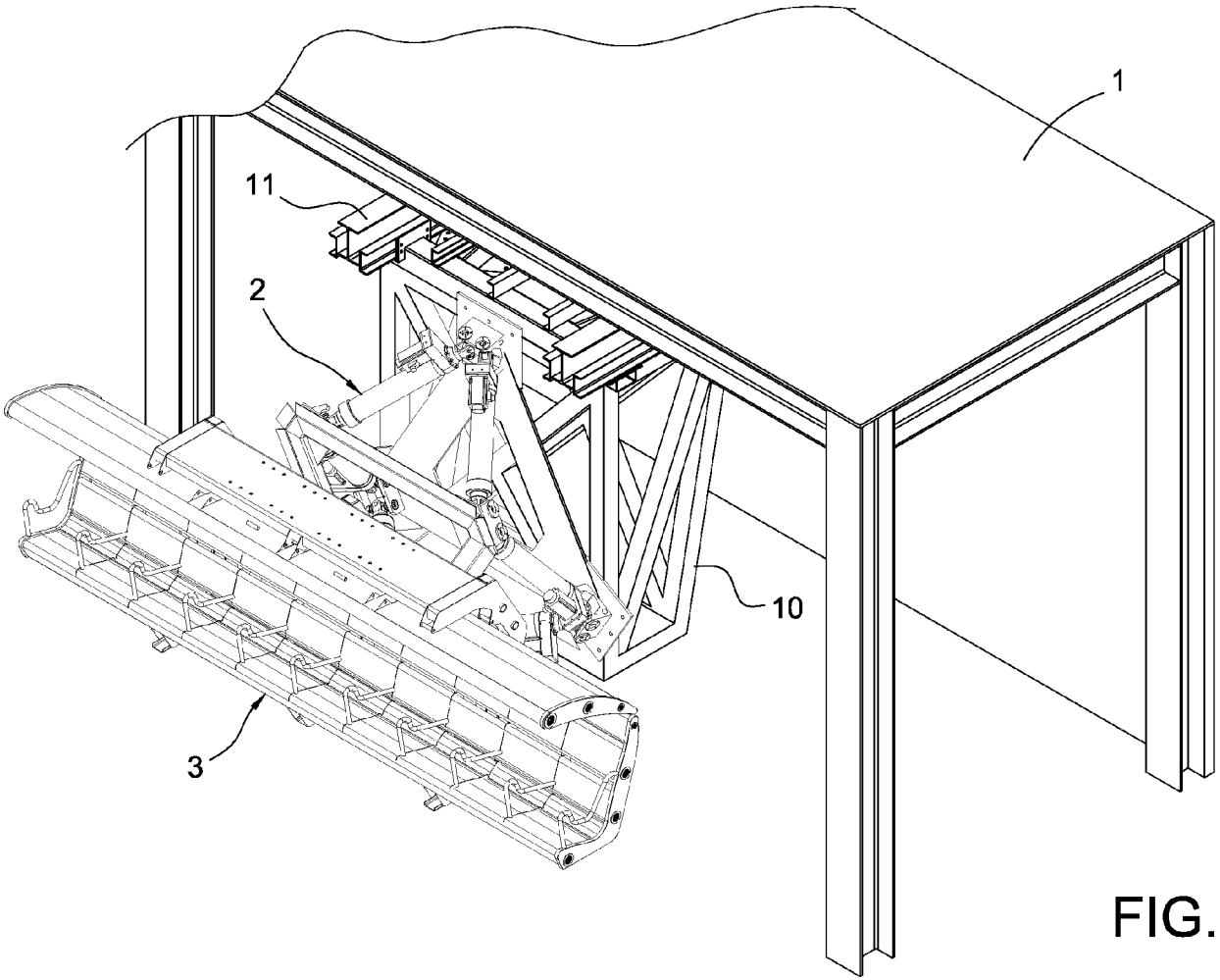
FIG. 7 is a perspective view of a motor mechanism according to another embodiment of the present invention

Moreover, the sliding track 11 can be positioned underneath the arm 10, or positioned above the arm 10 as shown in FIG. 7. The tripping accident can be avoided when the sliding track 11 is positioned above the arm 10.

Figure 5:
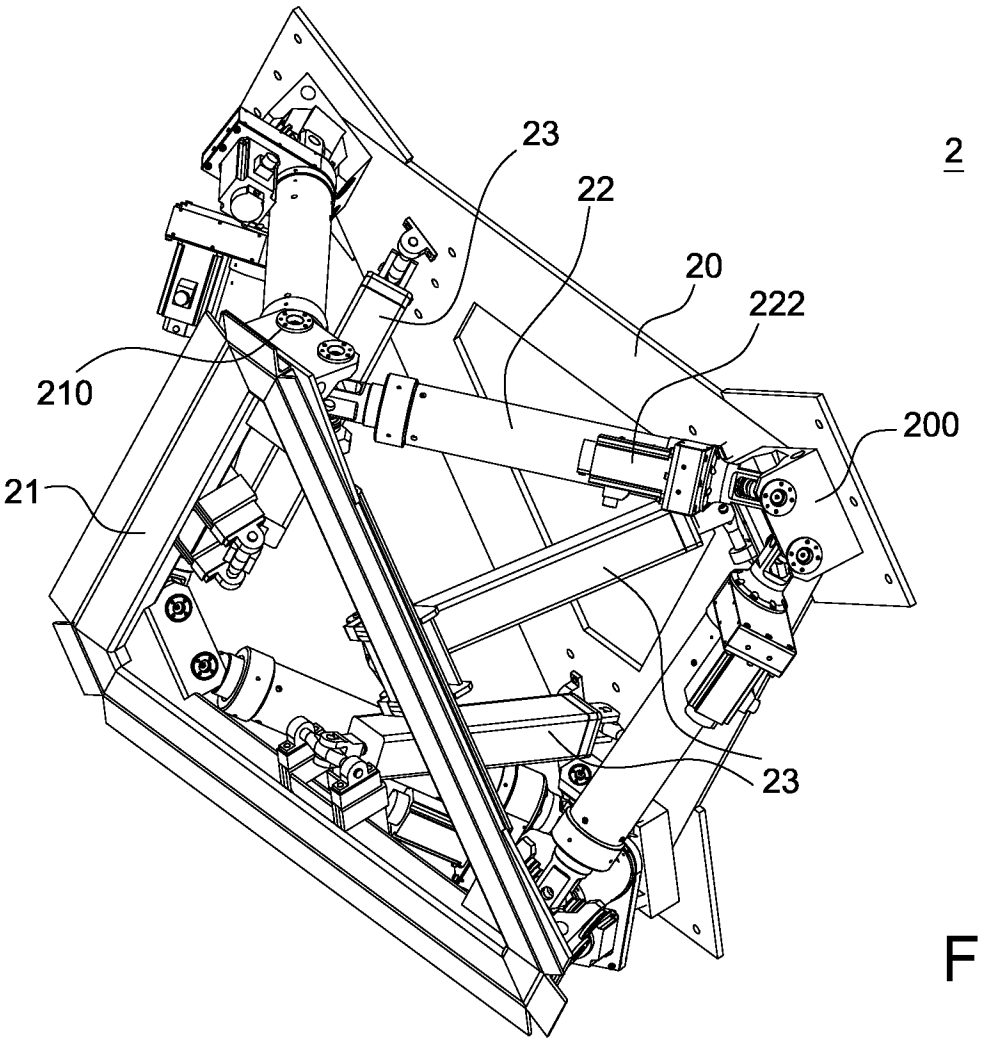
FIG. 5 is a perspective view of a motor mechanism according to another embodiment of the present invention.
Figure 6:
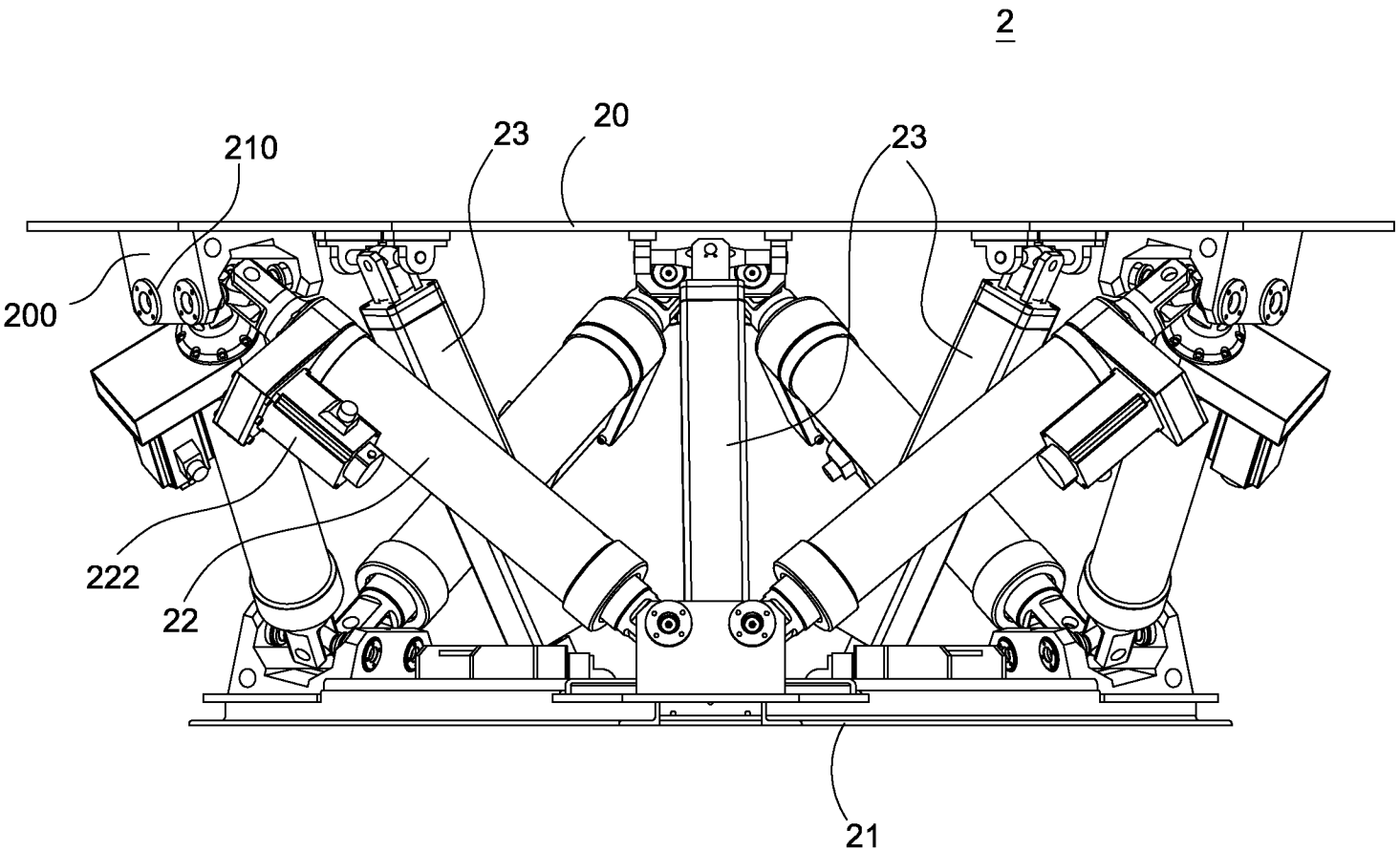
FIG. 6 is a planer graph of a motor mechanism according to another embodiment of the present invention.

Referring to FIGS. 5 and 6, to increase the stability for the motor mechanism 2 and support the carriage 3, bars 23 can be installed along the stretchable bars 22 to join the base 20 and the platform 21. With the reinforcement of the bars 23 for supporting the base 20 and the platform 21, the motor mechanism 2 can perform more steadily in supporting the carriage 3 in the lateral position, and accordingly to upgrade the safety.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A lateral dynamic simulation device, comprising a positioning platform (1), comprising an upright arm (10);

a motor mechanism (2), with multiple degrees of freedom, comprising a base (20), a platform (21) and a plurality of stretchable bars (22) connecting said base (20) and said platform (21); said stretchable bar (22), said base (20) and said platform (21) are joined by universal joints (220);

a carriage (3); and wherein said base (20) comprises a sliding track (11) to allow said arm (10) to slide horizontally, having a space (30) at a frontal portion for passengers to sit, and a back portion (31) at a rear side of said carriage (3);

wherein said base (20) of said motor mechanism (2) is fixed to said arm (10) of said positioning platform 1, and said platform (21) of said motor mechanism (2) is fixed to said back portion (31) of said carriage (3).

2. The lateral dynamic simulation device according to claim 1, wherein said sliding track (11) is positioned underneath or above said arm (10).

3. The lateral dynamic simulation device according to claim 1, wherein said motor mechanism (2) is a Stewart Platform.

4. The lateral dynamic simulation device according to claim 1, wherein said base (20) and platform (21) of said motor mechanism (2) are formed in triangular shape and positioned alternatively, and said stretchable bars (22) are joined to tips of triangles of said base (20) and said platform (21).

5. The lateral dynamic simulation device according to claim 4, wherein said base (20) and said platform (21) further comprise an axial portion (210) at triangle tips, and said axial portion (210) comprises hole (211) for adopting said universal joints (220) of the stretchable bar (22); said universal joints (220) of said stretchable bar (22) have protruded axle (221) axially positioned in the hole (211).

6. The lateral dynamic simulation device according to claim 5, wherein said hole (211) is formed as a C-shape opening.

7. The lateral dynamic simulation device according to claim 1, wherein said base (20) and platform (21) of the motor mechanism (2) further comprise an axial portion (210) having hole (211) formed correspondingly to receive said universal joint (220) of said stretchable bar (22); said every universal joint (220) of said stretchable bar (22) comprises an axle (221) to position axially in said hole (211); said hole (211) is formed as a C-shape opening.

8. The lateral dynamic simulation device according to claim 1, wherein said stretchable bars (22) of said motor mechanism (2) is a linear actuator, and can control a length by a motor device (222).

9. The lateral dynamic simulation device according to claim 1, wherein said motor device (222) can be a motor or an oil cylinder.

10. The lateral dynamic simulation device according to claim 1, wherein among every said stretchable bar (22) of said motor mechanism (2), bars (23) are position for joining said base (20) and said platform (21).

* * * * *